US008840208B2

(12) United States Patent
Hirose

(10) Patent No.: US 8,840,208 B2
(45) Date of Patent: Sep. 23, 2014

(54) PRINTING APPARATUS

(75) Inventor: Koji Hirose, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 118 days.

(21) Appl. No.: 13/430,045

(22) Filed: Mar. 26, 2012

(65) Prior Publication Data

US 2013/0027450 A1 Jan. 31, 2013

(30) Foreign Application Priority Data

Jul. 28, 2011 (JP) ..... 2011-165513

(51) Int. Cl.
*B41J 29/38* (2006.01)
*B41J 2/165* (2006.01)

(52) U.S. Cl.
CPC ..... *B41J 29/38* (2013.01); *B41J 2002/16573* (2013.01); *B41J 2/16526* (2013.01)
USPC ..... 347/9

(58) Field of Classification Search
CPC ..... B41J 29/38; B41J 2/16526; B41J 2002/16573
USPC ..... 347/5, 9, 14, 19, 21, 22, 29, 30
IPC ..... B41J 29/38
See application file for complete search history.

(56) References Cited

U.S. PATENT DOCUMENTS

| | | | | |
|---|---|---|---|---|
| 7,614,720 | B2 | 11/2009 | Otsuka | |
| 2004/0233245 | A1 * | 11/2004 | Matsumoto et al. | 347/19 |
| 2006/0214979 | A1 * | 9/2006 | Inoue | 347/22 |
| 2006/0244775 | A1 * | 11/2006 | Umeda | 347/19 |
| 2007/0172281 | A1 * | 7/2007 | Inoue et al. | 400/62 |
| 2007/0229583 | A1 | 10/2007 | Otsuka | |
| 2009/0066737 | A1 | 3/2009 | Sakurai | |
| 2010/0053241 | A1 * | 3/2010 | Chandu et al. | 347/9 |

FOREIGN PATENT DOCUMENTS

| | | | |
|---|---|---|---|
| JP | H06-008458 | A | 1/1994 |
| JP | H10-193628 | A | 7/1998 |
| JP | 2000-261515 | A | 9/2000 |
| JP | 2001-205898 | A | 7/2001 |

(Continued)

OTHER PUBLICATIONS

Japan Patent Office, Notification of Reasons for Rejection for Japanese Patent Application No. 2011-165513, mailed May 9, 2013.

*Primary Examiner* — Manish S Shah
*Assistant Examiner* — Roger W Pisha, II
(74) *Attorney, Agent, or Firm* — Merchant & Gould PC

(57) ABSTRACT

A printing apparatus includes: a printing section which discharges the ink to print an image; a storage section in which an image data of the image to be printed by the printing section is stored; a judgment section which judges as to whether or not a flushing condition to execute a flushing, in which the ink is discharged from the printing section irrespective of the printing of the image, is satisfied; and a controller which controls the printing section to execute the flushing in a case that the judgment section judges that the flushing condition is satisfied and that the image data is not stored in the storage section, and which controls the printing section to print the image instead of the flushing in a case that the judgment section judges that the flushing condition is satisfied and that the image data is stored in the storage section.

11 Claims, 7 Drawing Sheets

(56) References Cited

FOREIGN PATENT DOCUMENTS

| | | | |
|---|---|---|---|
| JP | 2004-262116 | A | 9/2004 |
| JP | 2004-358791 | A | 12/2004 |
| JP | 2005-045301 | A | 2/2005 |
| JP | 2007-290357 | A | 11/2007 |
| JP | 2008-137162 | A | 6/2008 |
| JP | 2009-066849 | A | 4/2009 |
| JP | 2009-172891 | A | 8/2009 |
| JP | 2009-271412 | A | 11/2009 |
| JP | 2010-234543 | A | 10/2010 |

* cited by examiner

PRINTING APPARATUS

CROSS REFERENCE TO RELATED APPLICATION

The present application claims priority from Japanese Patent Application No. 2011-165513, filed on Jul. 28, 2011, the disclosure of which is incorporated herein by reference in its entirety.

BACKGROUND OF THE INVENTION

1. Field of the Invention

The present invention relates to a printing apparatus which executes a flushing in which ink is jetted from nozzles in order to suppress clogging (blockage) of the ink in the nozzles.

2. Description of the Related Art

As for a printing apparatus of an ink jet type in which ink is jetted from nozzles to print an image, there has been known that a flushing in which the ink is jetted from the nozzles in order to suppress clogging (blockage) of the ink in the nozzles is executed, for example, at a timing based on a predetermined period, a timing at which the printing apparatus is powered on, or a timing depending on a usage of the printing apparatus by a user (see, for example, Japanese Patent Application Laid-open No. 2009-66849).

However, there is generated a problem such that, when the flushing is executed, the ink to be used for the printing of the image is decreased in an amount corresponding to the amount used in the flushing. In the present description, it is disclosed a technique in which the ink can be utilized effectively in the printing of the image while suppressing the clogging of the ink in the nozzles.

SUMMARY OF THE INVENTION

According to an aspect of the present teaching, there is provided a printing apparatus which discharges an ink to perform printing, including: a printing section which discharges the ink to print an image; a storage section in which an image data of the image to be printed by the printing section is stored; a judgment section which judges as to whether or not a flushing condition to execute a flushing, in which the ink is discharged from the printing section irrespective of the printing of the image, is satisfied; and a controller which controls the printing section to execute the flushing in a case that the judgment section judges that the flushing condition is satisfied and that the image data is not stored in the storage section, and which controls the printing section to print the image instead of the flushing in a case that the judgment section judges that the flushing condition is satisfied and that the image data is stored in the storage section.

The present teaching can be realized in various aspects, such as a flushing control method, a flushing control program, and a recording medium in which flushing control program is stored, etc.

According to the printing apparatus as described above, it is possible to use the ink effectively in the printing of the image while suppressing the clogging (blockage) of the ink in the nozzles.

DESCRIPTION OF THE PREFERRED EMBODIMENTS

First Embodiment

The first embodiment of the present teaching will be explained with reference to FIGS. 1 to 5B.

<Electrical Construction of Printer>

Figure 1:
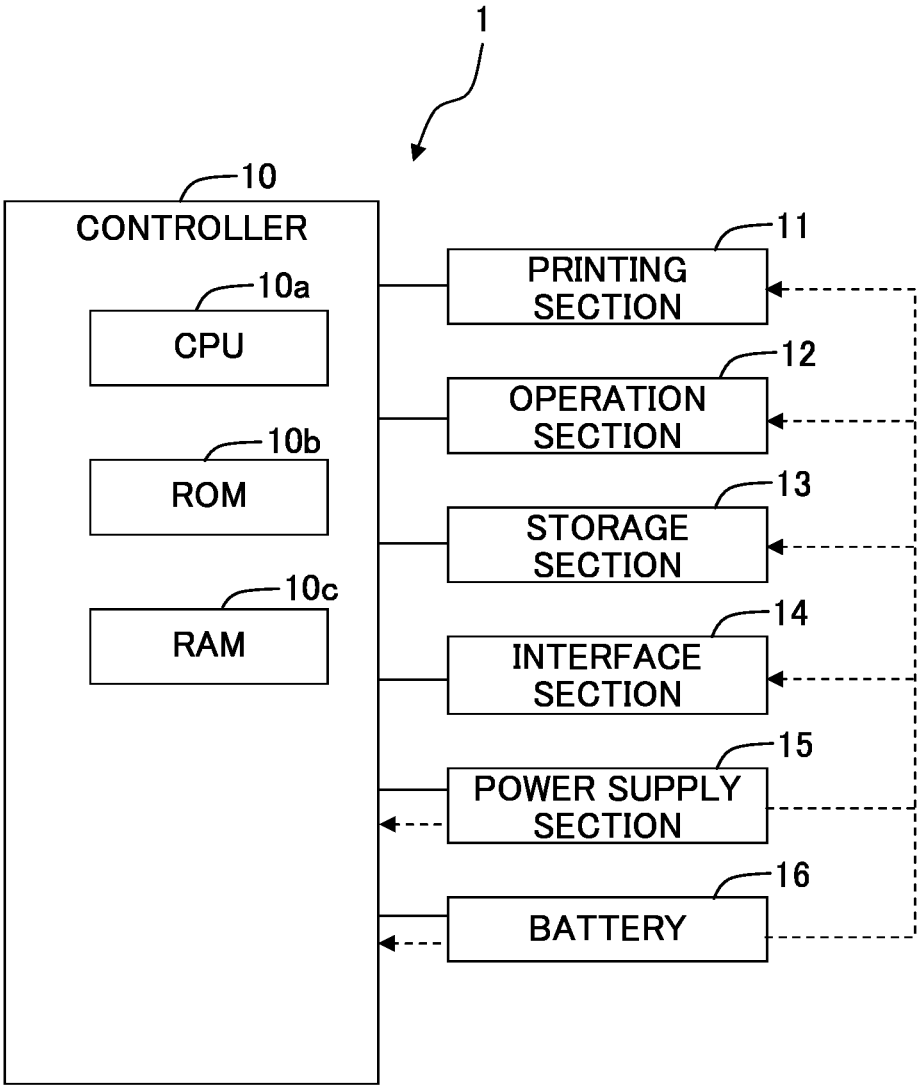
FIG. 1 is a block diagram showing an electrical structure of a printer according to the first embodiment.

As shown in FIG. 1, a printer 1 includes a controller 10, a printing section 11, an operation section 12, a storage section 13, an interface section 14, a power supply section 15, and a battery 16.

The controller 10 is configured to include a CPU 10*a*, a ROM 10*b*, a RAM 10*c*, etc. The CPU 10*a* executes various programs stored in the ROM 10*b* to control the respective constitutive parts or components of the printer 1. The ROM 10*b* stores control programs executed by the CPU 10*a*, a variety kinds of data, and the like. The RAM 10*c* is utilized as a main storage device to execute the various processes by the CPU 10*a*. The controller 10 is an example of a judgment section and a controller.

The printing section 11 is a device which jets inks of C (cyan), M (magenta), Y (yellow), and K (black) to print an image, in an inkjet manner, onto a sheet such as a printing paper sheet. The construction of the printing section 11 will be described later. The printing section 11 is an example of a printing section.

The operation section 12 (an example of a selecting section) is configured to include various buttons, a liquid crystal display, and the like. A user is able to operate the operation section 12 to perform various settings, a switching operation between operation modes as will be described later on, selection as to whether or not the later-described flushing printing is executed, etc.

The storage section 13 is a device which utilizes a nonvolatile memory such as a hard disk, a flush memory, and the like, to store various programs and data. The image which is received from an external apparatus, such as a personal computer, is stored in storage section 13.

The interface section 14 is configured, for example, as a USB (Universal Serial Bus) client interface. The interface section 14 receives the image from the external apparatus via a USB cable. It is noted that the printer 1 may be configured to be connected to the external apparatus via a LAN (Local Area Network) or a communication network such as the internet.

The power supply section 15 is connected to an external commercial power source and supplies the electric power, which is supplied from the external commercial power source, to the respective constitutive parts or components of the printer 1.

The battery 16 is a secondary battery which is charged with the electric power supplied from the power supply section 15. The battery 16 supplies the electric power to the respective constitutive parts or components of the printer 1 at the time of a power saving mode as will be described later on.

<Construction of Printing Section>

Figure 2:
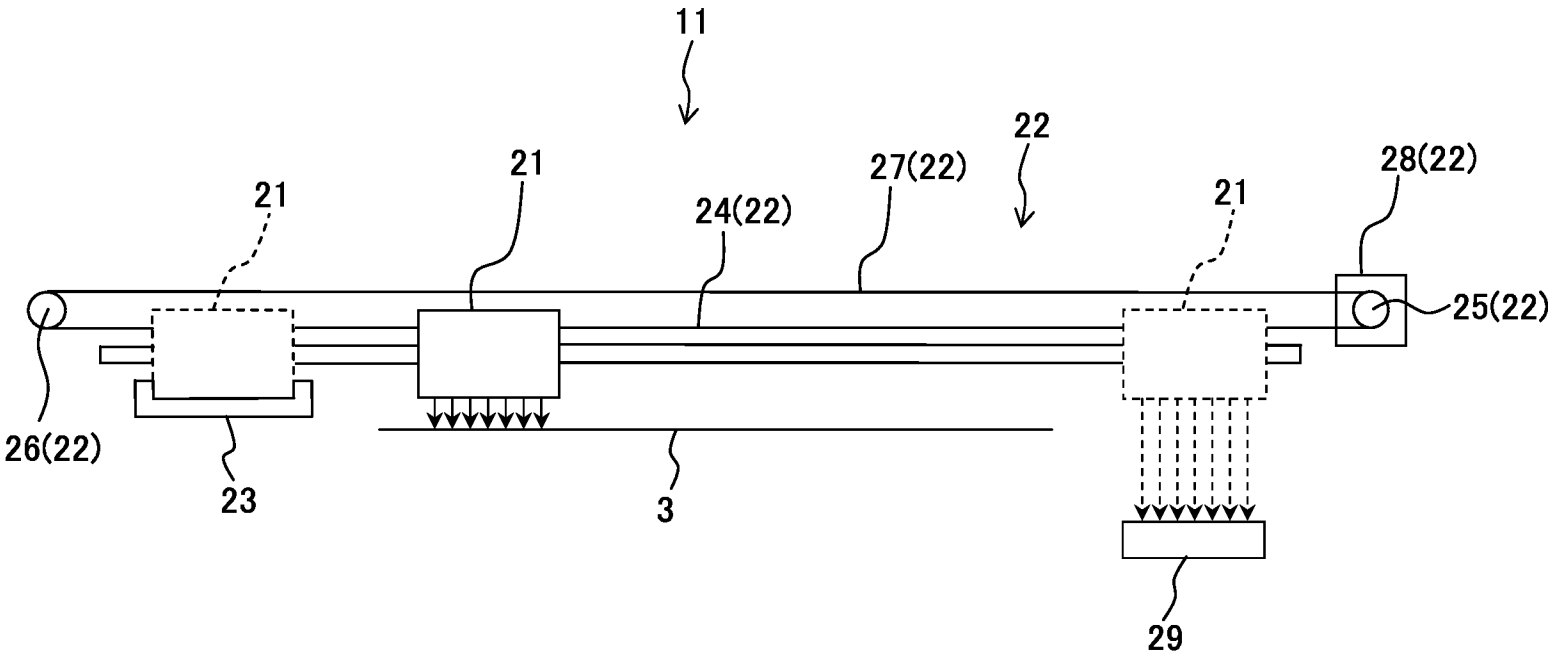
FIG. 2 schematically shows a construction of a printing section of the printer.

As shown in FIG. 2, the printing section 11 is configured to include a recording head 21, a recording head transport section 22, an unillustrated sheet transport section, a cap 23, and the like.

The recording head 21 is configured to include a plurality of ink cartridges in which the respective inks of C, M, Y, K are accommodated, a plurality of nozzles which are provided corresponding to the ink cartridges of the respective colors, an ink channel which connects the ink cartridge to the nozzles, a piezoelectric element which compresses the ink channel to jet the ink from the nozzles, a driving circuit which applies voltage to the piezoelectric element in accordance with a driving signal, which depends on the image to be printed, and the like.

The recording head transport section 22 is provided with a guide rod 24 which supports the recording head 21 slidably, a driving roller 25, a driven roller 26, a timing belt 27 suspended between the driving roller 25 and the driven roller 26, and a stepping motor 28 which drives and rotates the driving roller 25. The recording head transport section 22 reciprocatively moves the recording head 21 in a main scanning direction which is parallel to the guide rod 24.

The unillustrated sheet transport section is provided with a plurality of rollers, a stepping motor which drives and rotates the rollers, etc. The unillustrated sheet transport section transports a sheet 3 in a subsidiary scanning direction perpendicular to the paper surface of FIG. 2.

The cap 23 is disposed below a waiting position of the recording head 21. The cap 23 is configured to be movable in upward and downward directions by an unillustrated lifting mechanism. The cap 23 covers the recording head 21 located at the waiting position from a lower side to suppress drying of the inks in the nozzles.

<Operation Mode of Printer>

The operation modes of the printer 1 include a normal mode, the power saving mode in which the electric power lower than the normal mode is consumed, and a temporary recovery mode. The power saving mode is an example of a print-restriction mode. The switching operation between the normal mode and the power saving mode is performed such that the user operates the operation section 12 of the printer 1. The temporary recovery mode is a mode which is changed from the power saving mode in a case that supply of the electric power, which is higher than that of the power saving mode, is needed for respective constitutive parts or components of the printer 1 during the power saving mode.

In a case that the operation mode of the printer 1 is set as the normal mode and that the printer 1 has the image to be printed, the printer 1 prints the image. The image to be printed refers to an image, an image data of which is not yet transmitted to the printer 1 from the external apparatus although printing instruction was carried out by the user through the external apparatus, and an image which is not yet printed by the printer 1 although the image data of the image was transmitted to the printer 1 from the external apparatus. In a case that there is the image data which is not yet transmitted to the printer 1 from the external apparatus although printing instruction was carried out by the user through the external apparatus, the printer 1 receives the transmission of the image data from the external apparatus to print the image of the image data transmitted from the external apparatus.

On the other hand, in a case that the operation mode of the printer 1 is set as the power saving mode, even when the image to be printed is stored in the storage section 13, the printer 1 does not print the image in principle. For example, even if the printing instruction is made by the user through the external apparatus in a state that the printer 1 is in the power saving mode, the printer 1 does not receive the transmission of the image from the external apparatus. In a case that the printing instruction of the image is made by the user through the external apparatus in the state that the printer 1 is in the power saving mode, the image is stored in the external apparatus as a transmission-reserved image, and also it is stored in the storage section 13 of the printer 1 that such a transmission-reserved image is stored in the external apparatus. Further, in some cases, the normal mode is switched to the power saving mode by the user during a time after the printer 1 receives the image from the external apparatus to store the image in the storage section 13 and before the printer 1 prints the image. In that case, the printing of the image, which was received by the printer 1 and was stored in the storage section 13 but is not yet printed, is reserved, and the image is stored in the storage section 13 of the printer 1 as a printing-reserved image. In this embodiment, not only the case in which the image is stored in the storage section 13 of the printer 1 as the printing-reserved image but also the case in which it is stored in the storage section 13 of the printer 1 that the image is stored in the external apparatus as the transmission-reserved image is regarded as that the image to be printed is stored in the storage section 13.

<Flushing>

A flushing refers to a process as follows. That is, in a case that the ink is dried in the nozzles due to continuation of a state in which the printing is not carried out and that a predetermined execution condition (flushing condition) is satisfied, the ink is forcibly discharged, irrespective of the printing of the image, in order to suppress clogging of the ink. The flushing may be performed, for example, in a state that the nozzles of the recording head 21 are covered with the cap 23 or so that the ink is discharged, at a position deviated from the transport route of the sheet 3 in the main scanning direction, to an ink absorbing material 29 which is disposed below said position, as shown in FIG. 2.

In this embodiment, as to the execution condition of the flushing (flushing condition), an explanation will be made by citing a "case in which a certain period of time is elapsed after the latest flushing performed most recently was completed", as an example. Whether or not the certain period of time is elapsed after the latest flushing performed most recently was completed is judged for each of the ink colors. It is noted that the execution condition of the flushing is not limited to the example as described above, and may be set as appropriate. For example, the execution condition may be a "case in which the printer is powered on".

<Flushing in the Power Saving Mode>

As described above, the printer 1 does not perform the printing in principle in the case that the printer 1 is set as the power saving mode. However, as an exception, even when the printer 1 is in the power saving mode, in a case that the execution condition of the flushing is satisfied and that there is the image to be printed, the printer 1 prints the image instead of the flushing.

<Process of Controller in the Power Saving Mode>

Figure 3:
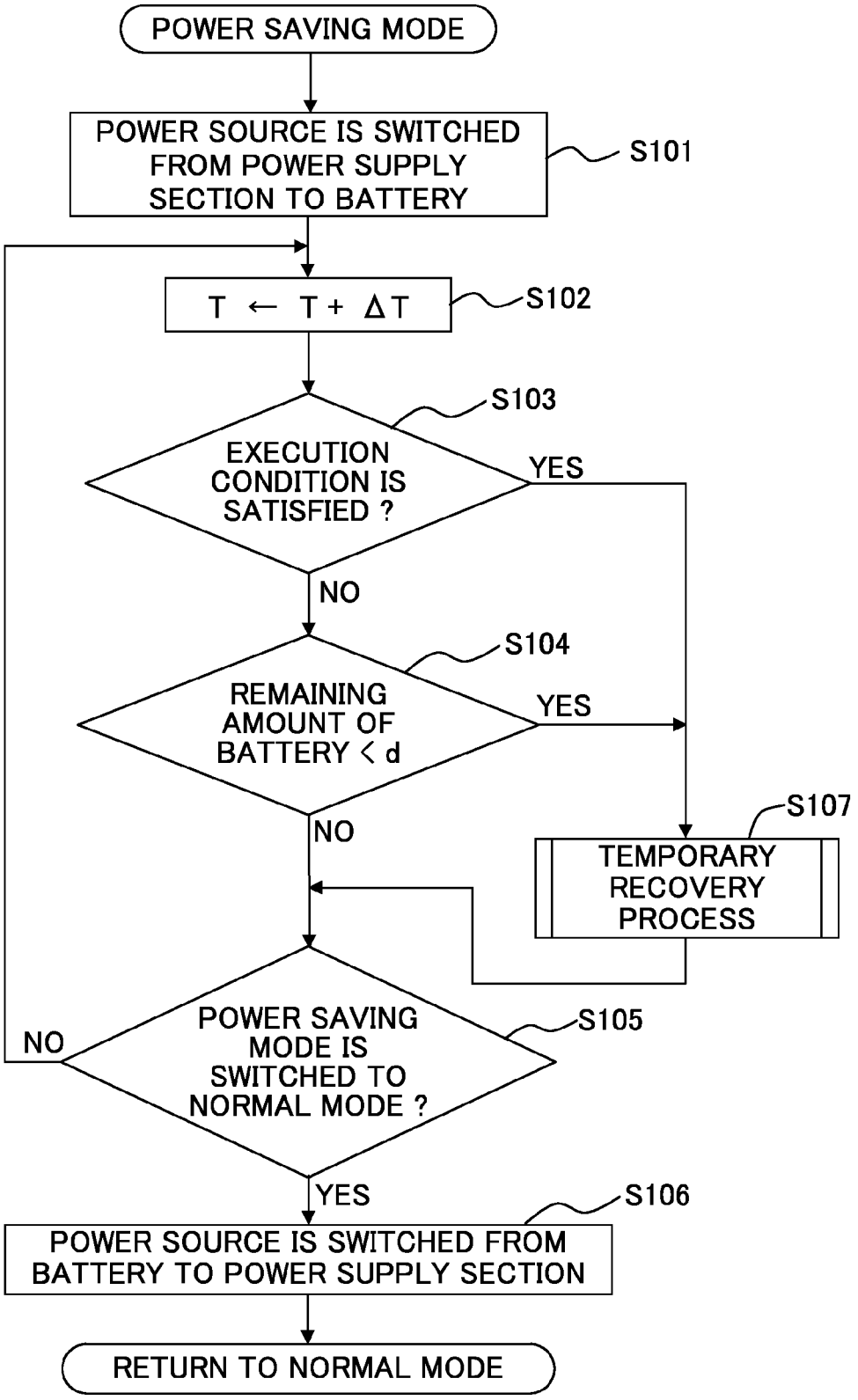
FIG. 3 is a flowchart showing a process of a controller in a power saving mode.

An explanation will be made about a process of the controller 10 in the power saving mode with reference to a flowchart of FIG. 3. This process is started when the user operates the operation section 12 so that the normal mode is switched to the power saving mode.

In S101, the power source by which the electric power is supplied to the respective constitutive parts or components of the printer 1 is switched, by the controller 10, from the power supply section 15 to the battery 16. It is noted that the power consumption may be reduced without switching the power source to the battery 16. For example, the electric power, which is supplied to the respective constitutive parts or components of the printer 1 by the power supply section 15, may be lower than that of the normal mode, or the electric power, which is supplied to the respective constitutive parts or components other than the controller 10 by the power supply section 15, may be blocked.

In S102, a time ΔT is added, by the controller 10, to a variable (Tcy, Tma, Tye, Tbk), which indicates an elapsed time, for each of the ink colors, elapsed after the latest flushing performed most recently is completed. Here, as to character strings added to the variable T, "cy" indicates cyan, "ma" indicates magenta, "ye" indicates yellow, and "bk" indicates black. In a case that no color is specified, the elapsed time is merely referred to as the elapsed time "T". Other variables are also referred to in a similar manner. The ΔT is a time from a point of time, at which the time is added to the elapsed time T most recently, to the present time. The elapsed time T is the variable which is shared with the normal mode. In a case that the process S102 is executed first, the time from a point of time, at which the time is added to the elapsed time T most recently during the normal mode, to the present time is the ΔT.

In S103, the controller 10 judges whether or not the execution condition of the flushing is satisfied. In particular, in a case that all of the elapsed times Tcy, Tma, Tye, Tbk are less than a certain period of time Ta, the controller 10 judges that the execution condition is not satisfied, and the controller 10 executes the process of S104. On the other hand, in a case that any one of the elapsed times Tcy, Tma, Tye, Tbk is not less than the certain period of time Ta, the controller 10 judges that the execution condition is satisfied, and the controller 10 executes a temporary recovery process of S107.

As will be described in detail later, in the temporary recovery process, the operation mode of the printer 1 is changed from the power saving mode to the temporary recovery mode. The temporary recovery mode is a mode in which the electric power supplied to the printer 1 is larger than that supplied in the power saving mode. The controller 10 uses the electric power supplied to the printer 1 to execute the flushing.

In S104, the controller 10 judges as to whether or not a remaining amount of the battery 16 is less than a threshold value d. In a case that the remaining amount of the battery 16 is not less than the threshold value d, the controller 10 executes the process of S105. On the other hand, in a case that the remaining amount of the battery 16 is less than the threshold value d, the controller 10 executes the temporary recovery process of S107. Here, the reason for executing the temporary recovery process in the case that the remaining amount of the battery 16 is less than the threshold value d is as follows. That is, in the temporary recovery mode, the electric power which is higher than that of the power saving mode is supplied to the printer 1 as described above. Thus, the electric power can be utilized to charge the battery 16.

In S105, the controller 10 judges as to whether or not the operation mode of the printer 1 is switched from the power saving mode to the normal mode by the user. In a case that the operation mode of the printer 1 is switched from the power saving mode to the normal mode, the process of S106 is executed. In a case that the operation mode of the printer 1 is not switched from the power saving mode to the normal mode, the process returns to S102 and the processes described above are repeated. In S106, the power source is switched from the battery 16 to the power supply section 15 by the controller 10 and the operation mode of the printer 1 is recovered from the power saving mode to the normal mode.

<Temporary Recovery Process>

Figure 4A:
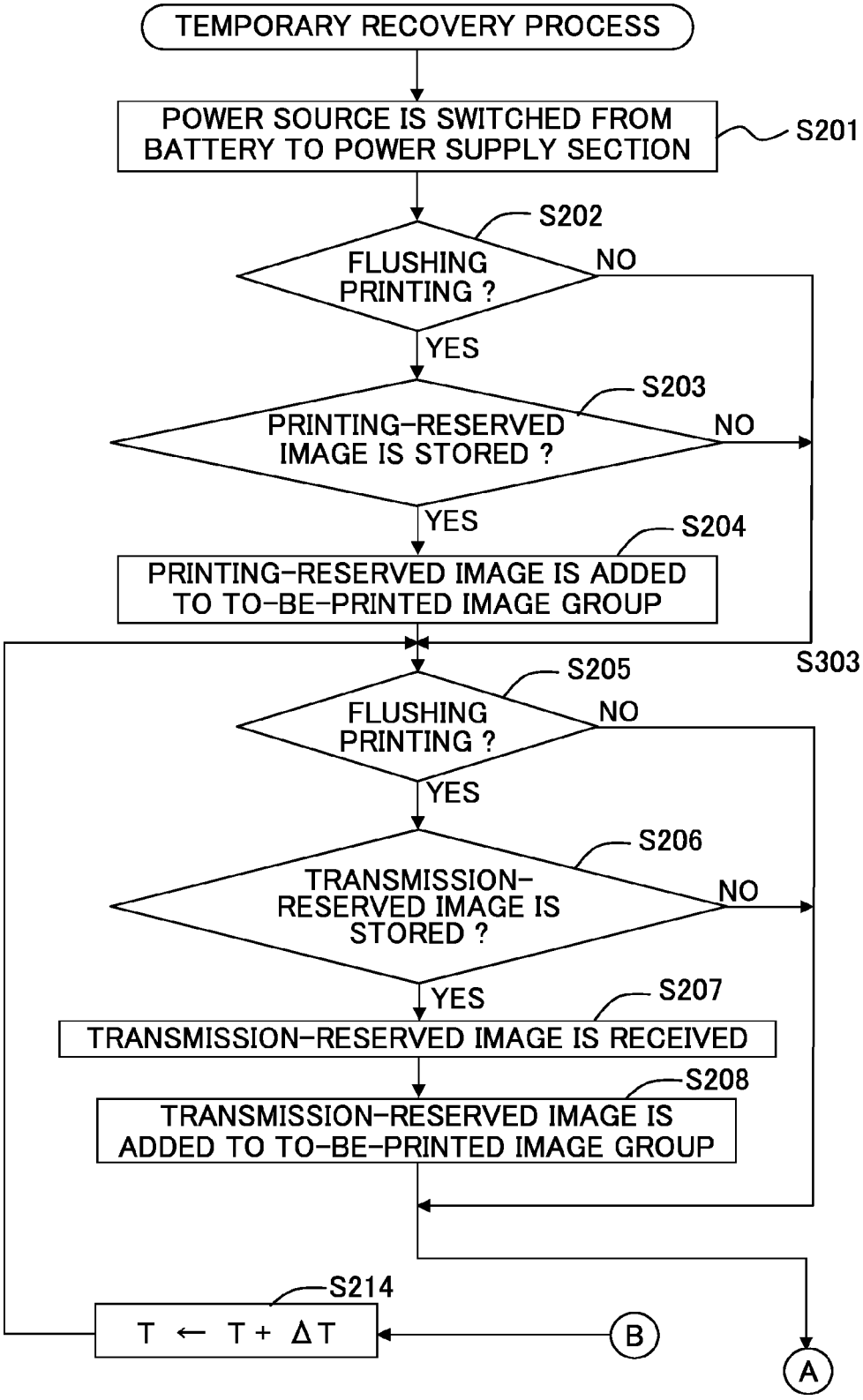
FIGS. 4A and 4B show a flowchart showing a temporary recovery process.
Figure 4B:
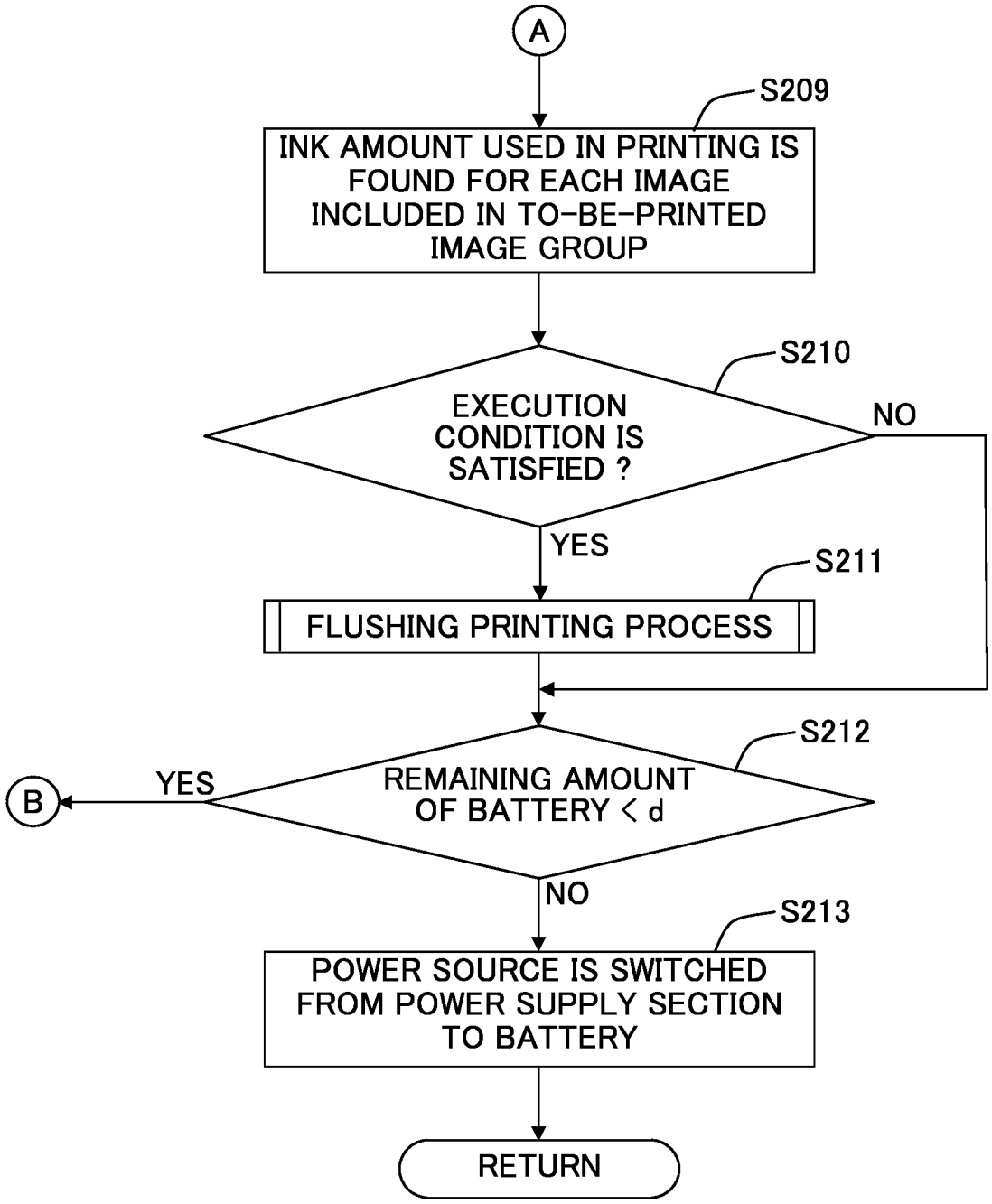

Next, a temporary recovery process will be explained with reference to a flowchart of FIGS. 4A and 4B. In S201, the power source is switched from the battery 16 to the power supply section 15 by the controller 10, so that the operation mode of the printer 1 is changed from the power saving mode to the temporary recovery mode.

In S202, the controller 10 judges as to whether or not the printing-reserved image is selected as a flushing printing objective. The flushing printing refers to a printing as follows. That is, in a case that the execution condition of the flushing is satisfied during the power saving mode and that there is an image data of the image to be printed stored in the storage section 13, the printing of the image is performed instead of the flushing. The user is capable of selecting the printing-reserved image as the flushing printing objective in advance by operating the operation section 12 (an example of the selecting section). In a case that the printing-reserved image is selected as the flushing printing objective, the image data of the printing-reserved image is added to a data group of a to-be-printed image group in S204 as will be described later on. In the case that the printing-reserved image is selected as the flushing printing objective, the controller 10 executes the process of S203. In a case that the printing-reserved image is not selected as the flushing printing objective, the controller 10 executes the process of S205.

In S203, the controller 10 judges as to whether or not the image data of the printing-reserved image is stored in the storage section 13. In a case that the image data of the printing-reserved image is stored in the storage section 13, the process of S204 is executed. In a case that the image data of the printing-reserved image is not stored in the storage section 13, the process of S205 is executed. In S204, the image data of the printing-reserved image is added to the data group of the to-be-printed image group by the controller 10. The image data which is added to the image data group is a candidate of the image data of the image which is printed instead of the flushing.

In S205, the controller 10 judges as to whether or not the transmission-reserved image is selected as the flushing printing objective. The user is capable of selecting the transmission-reserved image as the flushing printing objective in advance by operating the operation section 12. In a case that the transmission-reserved image is selected as the flushing printing objective, an image data of the transmission-reserved image is added to the data group of the to-be-printed image group in S208 as will be described later on. In the case that the transmission-reserved image is selected as the flushing printing objective, the controller 10 executes the process of S206. In a case that the transmission-reserved image is not selected as the flushing printing objective, the controller 10 executes the process of S209.

In S206, the controller 10 communicates with the external apparatus to judge as to whether or not the image data of the transmission-reserved image, the transmission of which to the printer 1 is reserved, is stored in the external apparatus. In a case that the image data of the transmission-reserved image is stored, the process proceeds to S207. In a case that the image data of the transmission-reserved image is not stored, the process proceeds to S209. In S207, the controller 10 receives the image data of the transmission-reserved image from the external apparatus. In S208, the controller 10 adds the image data of the transmission-reserved image received from the external apparatus to the data group of the to-be-printed image group.

In S209, the controller 10 finds an ink amount used in the printing for each ink color and for each image included in the to-be-printed image group. In particular, the controller 10 finds the ink amount by counting the number of dots formed on the sheet 3. This is because the ink amount is proportional to the number of dots. The image data of the image is subjected to a color space conversion process, a halftone process, or the like, and a binary image (monochrome image) which shows a dot pattern formed on the sheet 3 by the printing section 11 is created for each of the ink colors. Then, the controller 10 counts the number of dots of the created binary image. In a case that the image data of the image received from the external apparatus has already been converted into the binary image, the number of dots of said binary image may be counted.

In S210, the controller 10 again judges as to whether or not the execution condition of the flushing is satisfied. The reason thereof is as follows. That is, even when it is judged in S103 that the execution condition of the flushing is not satisfied, when it is judged in S104 that the remaining amount of the battery 16 is less than the threshold value d, the operation mode of the printer 1 is changed from the power saving mode to the temporary recovery mode. In this case, even if the execution condition is not satisfied at the timing at which the judgment in S103 is performed, the time elapses before the judgment in S210 is executed. Therefore, there is a possibility of satisfying the execution condition. In the case that the execution condition is satisfied, the controller 10 executes the process of S211. In the case that the execution condition is not satisfied, the controller 10 executes the process of S212.

In S211, the controller 10 executes a flushing printing process as will be described later on. In S212, the controller 10 judges as to whether or not the remaining amount of the battery 16 is less than the threshold value d. In a case that the controller 10 judges that the remaining amount of the battery 16 is not less than the threshold value d, the process of S213 is executed. In a case that the controller 10 judges that the remaining amount of the battery 16 is less than the threshold value d, the process of S214 is executed. Further, the following case is also allowable. That is, in a case that the battery 16 is charged so that the remaining amount of the battery 16 is enough greater than the threshold value d, the process proceeds to S213.

In S213, the power source is switched from the power supply section 15 to the battery 16 by the controller 10, and thereby the operation mode of the printer 1 is returned from the temporary recovery mode to the power saving mode. In S214, the controller 10 adds the time ΔT, which is a time from a point of time at which the time is added most recently to the present time, to the elapsed time (Tcy, Tma, Tye, Tbk). Then, the process returns to S205.

<Flushing Printing Process>

Figure 5A:
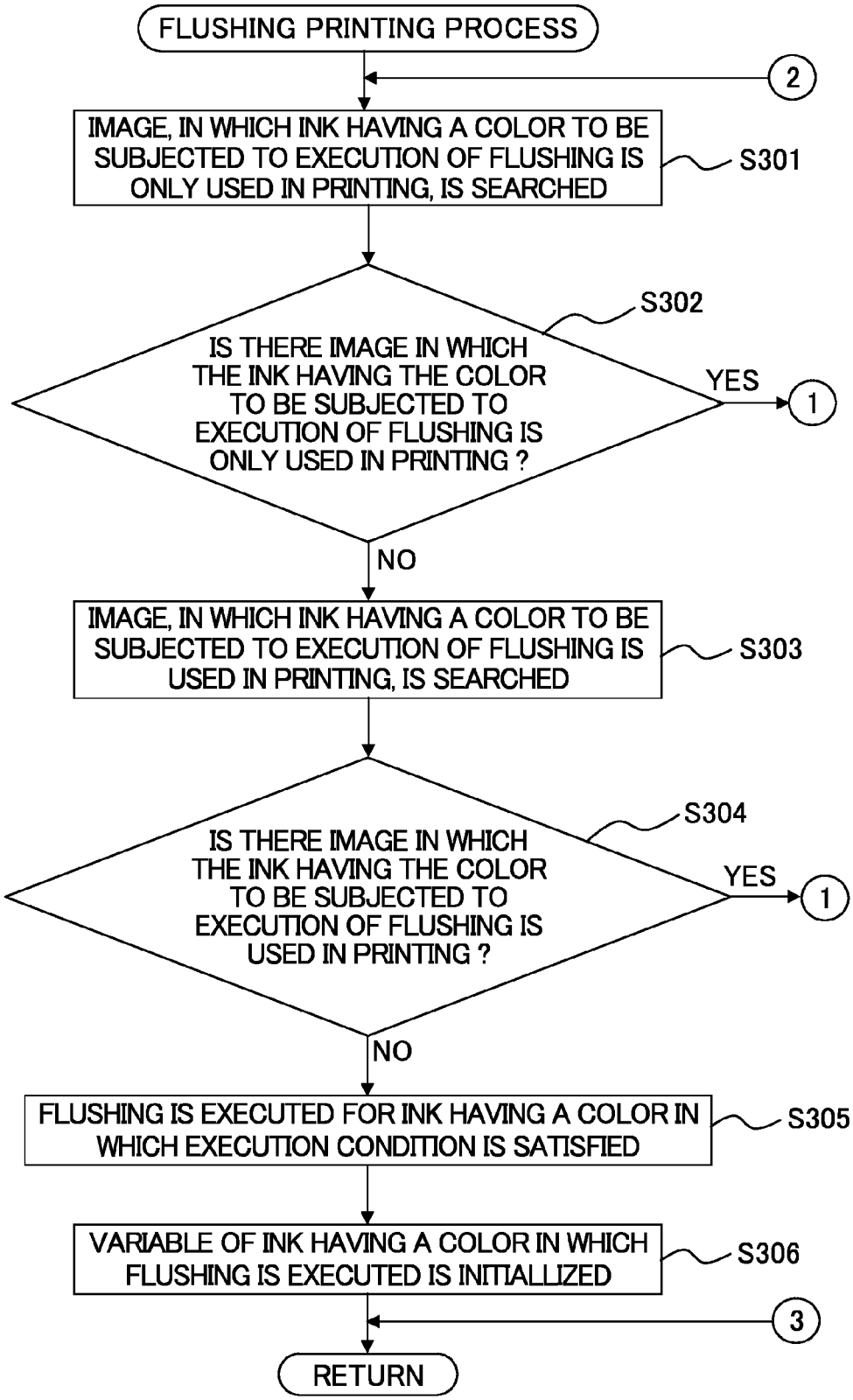
FIGS. 5A and 5B show a flowchart showing a flushing printing process.
Figure 5B:
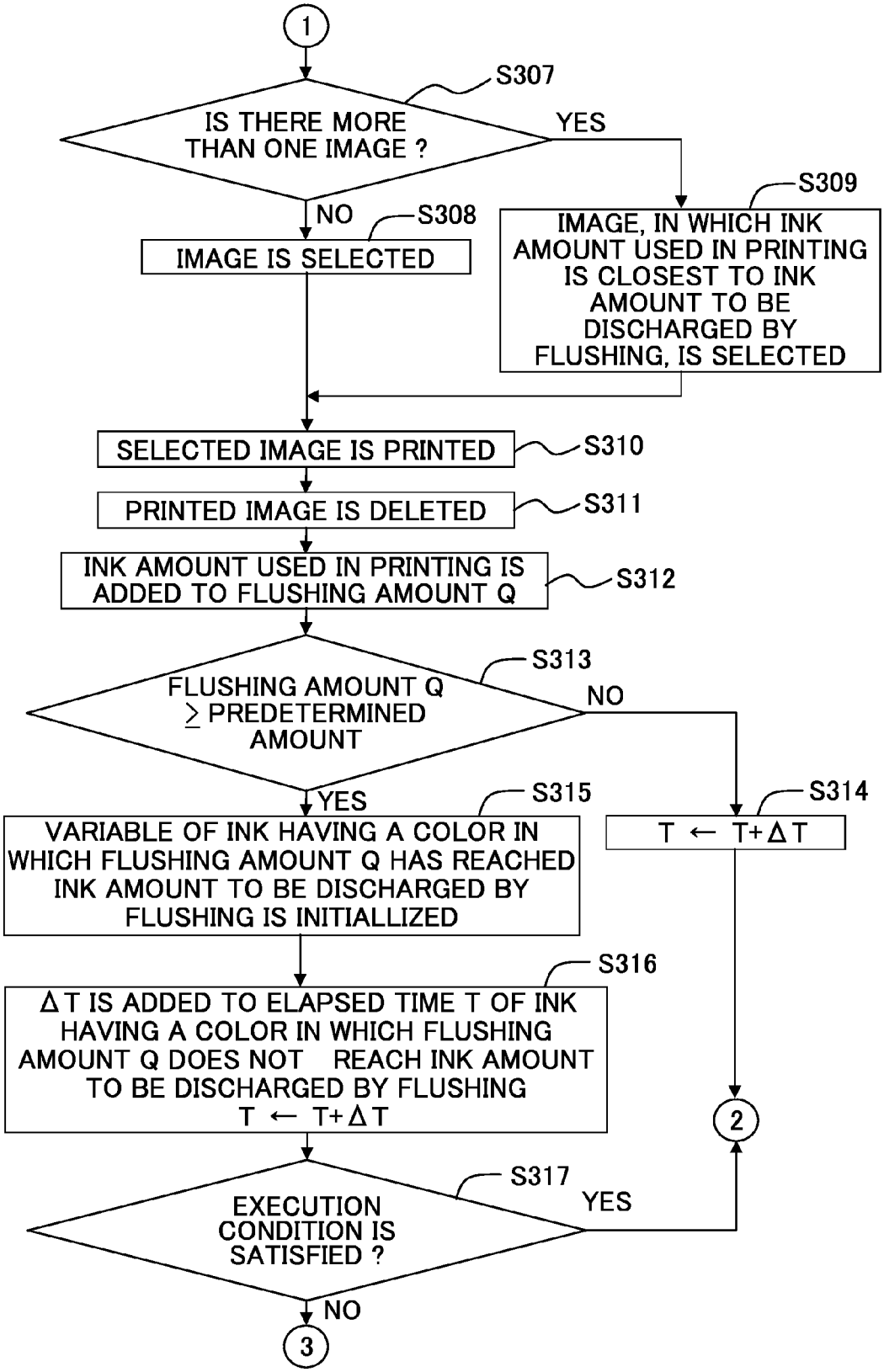

Next, an explanation will be made about the flushing printing process with reference to a flowchart of FIGS. 5A and 5B. In S301, the controller 10 searches the image, from among the images in the to-be printed image group, which is to be printed by using only the ink having the color to be subjected to the execution of the flushing. For example, it is assumed that the elapsed time Tbk of the black ink is not less than the certain period of time Ta and that the elapsed times Tcy, Tma, Tye of the inks of cyan, magenta, and yellow are less than the certain period of time Ta. In this case, the controller 10 searches the image which is to be printed by using only the black.

In S302, the controller 10 judges as to whether or not there is the image data of the image, which is to be printed by using only the ink having the color to be subjected to the execution of the flushing, stored in the storage section 13. In a case that there is no image data of the image, which is to be printed by using only the ink having the color to be subjected to the execution of the flushing, stored in the storage section 13, the controller 10 executes the process of S303. In a case that there is the image data of the image, which is to be printed by using only the ink having the color to be subjected to the execution of the flushing, stored in the storage section 13, the controller 10 executes the process of S307.

In S303, the controller 10 searches the image, from among the images in the to-be printed image group, which is to be printed by using the ink having the color to be subjected to the execution of the flushing. For example, it is assumed that the elapsed times Tcy, Tbk of the inks of cyan and black are not less than the certain period of time Ta and that the elapsed times Tma, Tye of the inks of magenta and yellow are less than the certain period of time Ta. In this case, the controller 10 searches the image which is to be printed by using the inks of cyan and black. Note that it is allowable to use any ink in addition to the inks of cyan and black, provided that the inks of cyan and black are used in the printing.

In the above example, the controller 10 searches the image in which both of the inks of cyan and black are used in the printing. However, it is allowable that the controller 10 searches the image in which any one of the inks of cyan and black is used in the printing. This is because, the ink can be used more effectively, even when only one of the inks is used in printing.

In S304, the controller 10 judges as to whether or not there is the image which is to be printed by using the ink having the color to be subjected to the execution of the flushing. In a case that there is not the image which is to be printed by using the ink having the color to be subjected to the execution of the flushing, the controller 10 executes the process of S305. In a case that there is the image which is to be printed by using the ink having the color to be subjected to the execution of the flushing, the controller 10 executes the process of S307. In S305, the controller 10 controls the printing section 11 to execute the flushing of the ink having the color in which the elapsed time T is not less than the certain period of time Ta. In S306, the controller 10 initializes the variable of the ink having the color in which the flushing is executed. In particular, the controller 10 initializes the elapsed time T of the ink having the color in which the flushing is executed to 0 (zero) and initializes a flushing amount Q, which is a variable in which the ink amount discharged by the flushing is counted for each of the ink colors, to 0 (zero).

In S307, in the case that it is judged in S302 that there is the image which is to be printed by using only the ink having the color to be subjected to the execution of the flushing, the controller 10 judges as to whether or not there is more than one said image. On the other hand, in the case that it is judged in S304 that there is the image which is to be printed by using the ink having the color to be subjected to the execution of the flushing, the controller 10 judges as to whether or not there is more than one said image. In a case that the controller 10 judges that there is only one said image, the process of S308 is executed. In a case that the controller 10 judges that there is more than one said image, the process of S309 is executed.

In S308, the controller 10 selects the image which is to be printed by using the ink having the color to be subjected to the execution of the flushing. In S309, the controller 10 selects the image, from among the images described above, which is to be printed by using the ink amount closest to the ink amount to be discharged by the flushing. For example, it is assumed that the elapsed times Tcy, Tbk of the inks of cyan and black are not less than the certain period of time Ta and that the elapsed times Tma, Tye of the inks of magenta and yellow are less than the certain period of time Ta. Further, it is assumed that the amount of the black ink used in the printing is Xbk, the amount of the black ink to be discharged by the flushing is Ybk, the amount of the cyan ink used in the printing is Xcy, and the amount of the cyan ink to be discharged by the flushing is Ycy. In this case, the controller 10 selects the image, from among the images described above, in which a difference Z calculated from the following expression (1) is smallest. As described above, by performing the printing to use the ink in an amount, which is closer to the ink amount to be discharged by the flushing, it is possible to suppress waste of the ink while obtaining the effect similar to the flushing.

$$\text{Difference } Z=|Xbk-Ybk|+|Xcy-Ycy| \quad \text{[Expression 1]}$$

Here, it is possible to use the ink amount obtained in S209 described above as the ink amount used in the printing. Further, it is assumed that the ink amount to be discharged by the flushing is converted into the number of dots in advance.

In S310, the controller 10 controls the printing section 11 to print the selected image. In S311, the controller 10 deletes the image data of the printed image from the storage section 13. In S312, the controller 10 adds the ink amount used in the printing of S310 to the flushing amount (Qcy, Qma, Qye, Qbk). That is, the controller 10 regards the ink amount used in the printing as the ink amount discharged by the flushing, and adds the ink amount used in the printing to the flushing amount Q.

In S313, the controller 10 judges as to whether or not the flushing amount Q reaches a predetermined amount to be discharged by the flushing, for each of the colors in which the elapsed time T is not less than the certain period of time Ta. In a case that there is at least one ink having the color in which the flushing amount Q does not reach the predetermined amount, among the inks having the colors, the respective elapsed times T of which are not less than the certain period of time Ta, the controller 10 judges that the flushing is not completed and the controller 10 performs the process of S314. On the other hand, in a case that the flushing amounts Q of all of the inks having the colors, the respective elapsed times T of which are not less than the certain period of time Ta, reach the predetermined amounts respectively, the controller 10 judges that the flushing is completed and the controller 10 performs the process of S315. In S314, the time ΔT elapsed after the time is added most recently is added to the elapsed time (Tcy, Tma, Tye, Tbk) by the controller 10. Then, the process returns to S301.

In S315, the controller 10 initializes the variable of the ink having the color in which the flushing amount Q has reached the predetermined amount. In particular, the controller 10 initializes the elapsed time T of the ink having the color, the flushing amount Q of which has reached the predetermined amount, to 0 (zero) and initializes the flushing amount Q to 0 (zero). In S316, the time ΔT elapsed after the time is added most recently is added, by the controller 10, to the elapsed time T of the ink having the color the flushing amount Q of which does not reach the predetermined amount. In S317, the controller 10 again judges as to whether or not the execution condition of the flushing is satisfied. In the case that all of the elapsed times Tcy, Tma, Tye, Tbk are less than the certain period of time Ta (S317: NO), the controller 10 judges that the execution condition is not satisfied. Then, the process proceeds to the temporary recovery process. On the other hand, in the case that any one of the elapsed times Tcy, Tma, Tye, Tbk is not less than the certain period of time Ta (S317: YES), the controller 10 judges that the execution condition is satisfied. Then, the process returns to S301.

Effect of First Embodiment

In the printer 1 according to the embodiment described above, in the case that it is judged that the execution condition of the flushing is satisfied; and that there is no image data of the image to be printed in the storage section 13, the flushing is executed by the printing section 11 (S305). In the case that it is judged that the execution condition of the flushing is satisfied; and that there is the image data of the image to be printed in the storage section 13, the image is printed by the printing section 11 instead of the flushing (S310). In any case, the ink is discharged provided that the execution condition of the flushing is satisfied. Thus, in the case that the execution condition of the flushing is satisfied and that there is the image data of the image to be printed in the storage section 13, the image is printed instead of the flushing. Accordingly, it is possible to effectively use the ink in the printing of the image while suppressing the clogging of the ink in the nozzles.

Further, even when the printer 1 is in the power saving mode, in the case that it is judged that the execution condition of the flushing is satisfied and that there is the image data of the image to be printed in the storage section 13, the controller 10 controls the printing section 11 to print the image instead of executing the flushing (S310). Even when the printer 1 is in the power saving mode, the ink is anyway discharged provided that the execution condition of the flushing is satisfied. Thus, by printing the image instead of the flushing, it is possible to effectively use the ink in the printing of the image while suppressing the clogging of the ink in the nozzles.

Further, in the printer 1 according to this embodiment, the controller 10 controls the printing section 11 to print the image which is to be printed by using the ink having the color to be subjected to the execution of the flushing. If the image which is to be printed without using the ink having the color to be subjected to the execution of the flushing, the ink having the color to be subjected to the execution of the flushing is not discharged in the printing. Thus, the printing does not serve as the flushing. On the other hand, in the case that the image which is to be printed by using the ink having the color to be subjected to the execution of the flushing, the ink having the color to be subjected to the execution of the flushing is discharged in the printing. Thus, the printing serves as the flushing and thereby making possible to suppress the clogging of the ink in the nozzles.

Further, in the printer 1 according to this embodiment, in the case that there is the image data of the image which is to be printed by using only the ink having the color to be subjected to the execution of the flushing in the storage section 13, said image is printed. Accordingly, it is possible to suppress that the ink having the color which does not require the execution of the flushing is discharged wastefully.

Further, in the printer 1 according to this embodiment, even when there is the image to be printed at the time when the execution condition of the flushing is satisfied, in a case that said image is to be printed without using the ink having the color to be subjected to the execution of the flushing, said image is not printed. Accordingly, it is possible to suppress that unnecessary printing is performed.

Further, in the printer 1 according to this embodiment, in the case that the execution condition of the flushing is satisfied and that there are the plurality of images to be printed, the ink amount used in the printing for each of the images is judged and the image, which is to be printed by using the ink amount closest to the ink amount to be discharged by the flushing, is printed. By doing so, it is possible to reduce as follows. That is, the printing of the image does not serve as the flushing by using the ink in the printing in the amount much less than the amount to be discharged by the flushing. Or, it is possible to suppress as follows. That is, the printing is performed by using the ink in the amount larger than the amount to be discharged by the flushing, and as a consequence, the image is unnecessarily printed during the power saving mode in which the printing should be restricted, in spite of the situation such that the execution of the flushing is not required.

Further, in the printer 1 according to this embodiment, in the case that the image is printed instead of the flushing and that the ink amount used in the printing is less than the ink amount to be discharged by the flushing, the process returns to S301 and the flushing printing process is continued. In other words, in the case that the ink amount used in the printing is less than the ink amount to be discharged by the flushing, the flushing printing process is repeated to execute the flushing after the printing. Accordingly, in the printer 1, it is possible to reliably discharge the ink in the amount to be discharged by the flushing.

Further, in the printer 1 according to this embodiment, in the case that the image is printed instead of the flushing, the user is capable of selecting whether the printing-reserved image is printed instead of the flushing, whether the transmission-reserved image is printed instead of the flushing, or whether both the printing-reserved image and the transmission-reserved image are printed instead of the flushing. Thus, it is possible to improve freedom of choice by the user.

Second Embodiment

Next, the second embodiment of the present teaching will be explained. In S310 of the first embodiment, in the case that the image is printed, said image is printed to the end. In the second embodiment, however, in a case that the ink amount used in the printing exceeds the predetermined amount to be discharged by the flushing, the printing is discontinued at the point in time at which the ink amount used in the printing exceeds the predetermined amount.

For example, in a case that there are two color inks, the elapsed times T of which are not less than the certain period of time Ta, and that the flushing amount Q of the ink having one color of the two colors has reached the predetermined amount earlier than the ink having the other color, in the middle of printing, the printing is continued until the flushing amount Q of the ink having the other color reaches the predetermined amount. In a case that the flushing amounts Q of the inks of both of the colors have reached the predetermined amounts respectively, the printing is discontinued even when the printing is not completed. In a case that the printing of the image is discontinued, the printing may be resumed next time the image is printed instead of the flushing. Alternatively, in the case that after the printing is discontinued and further that the power saving mode is recovered to the normal mode without satisfying the execution condition of the flushing, the printing may be resumed when the power saving mode is recovered to the normal mode.

In the printer 1 according to the second embodiment as described above, in the case that the execution condition of the flushing is satisfied during the power saving mode, it is possible to suppress a situation, in which the printing is unnecessarily performed by using the ink in the amount larger than the amount to be discharged by the flushing in the power saving mode in which the printing should be restricted.

Other Embodiment

The present teaching is not limited to the embodiments explained through the above descriptions and drawings but, for example, the following embodiments are also included in the technical scope of the present teaching.

In the above embodiments, the image is printed instead of the flushing in the case that the execution condition of the flushing is satisfied and that there is the image to be printed. However, it is allowable that the user selects as to whether or not the image is printed instead of the flushing.

In the above embodiments, the image is printed instead of the flushing in the case that the execution condition of the flushing is satisfied during the power saving mode and that there is the image to be printed. However, the following case is also allowable. That is, even during the normal mode, in the case that the execution condition of the flushing is satisfied and that there is the image to be printed, the image is printed instead of the flushing.

In the above embodiments, description is made by citing the power saving mode as an example of the print-restriction mode in which the printing is not performed even when there is the image to be printed. However, the print-restriction mode may be those different from the power saving mode. For example, the print-restriction mode may be a print-prohibition mode as follows. That is, an upper limit of the number of sheets 3 to be printed and/or an upper limit of the ink amount used in the printing can be set by the user. In a case that the number of sheets 3 and/or the ink amount used in the printing has (have) reached the upper limit(s), the printing is not performed even when there is the image to be printed.

In the above embodiments, description is made by citing the color printer which uses the plurality of color inks to print the image as an example. However, the printer may be a black and white printer which uses, for example, the black ink only to perform the printing.

In the above embodiments, in the case that it is judged in S313 that there is the ink having the color in which the flushing amount Q does not reach the predetermined amount to be discharged by the flushing, the process returns to S301 to execute the flushing again. However, the following case is also allowable. That is, only the ink having the color, in which the flushing amount Q does not reach the predetermined amount, is discharged by the flushing, before the printing of S310, in an amount corresponding to the shortage of the predetermined amount. Alternatively, the ink having the color, in which the flushing amount Q does not reach the predetermined amount, may be discharged, in the amount corresponding to the shortage of the predetermined amount, by being divided into before and after the printing of S310.

In the above embodiments, description is made by citing the controller 10 provided with the CPU as an example of the judgment section and the controller. However, the judgment section and the controller may be realized by ASIC. Further, the judgment section and the controller may be realized by CPUs or ASICs different from each other.

In the above embodiments, in the case that the image is printed instead of the flushing, the image to be printed is selected from the printing-reserved image and the transmission-reserved image. However, the following case is also allowable. That is, a specific image is selected, by the user, during the normal mode, as the image to be printed instead of the flushing.

What is claimed is:

1. A printing apparatus which discharges ink to perform printing, comprising:

a printing section which discharges the ink to print an image;

a storage section in which an image data of the image to be printed by the printing section is stored;

a judgment section which judges as to whether or not a flushing condition to execute a flushing, in which the ink is discharged from the printing section irrespective of the printing of the image, is satisfied; and a controller which controls the printing section to execute the flushing in a case that the judgment section judges that the flushing condition is satisfied and that the image data is not stored in the storage section, and which controls the printing section to print the image instead of executing the flushing in a case that the judgment section judges that the flushing condition is satisfied and that the image data is stored in the storage section such that printing the image serves as the flushing.

2. The printing apparatus according to claim 1, wherein the printing apparatus has operation modes including a normal mode in which the image is printed in a case that the image data is stored in the storage section, and a print-restriction mode in which the printing of the image is limited even if the image data is stored in the storage section; and in a case that the judgment section judges that the flushing condition is satisfied during the print-restriction mode and that the image data is stored in the storage section, the controller controls the printing section to print the image instead of the flushing.

3. The printing apparatus according to claim 2, wherein the print-restriction mode is a power saving mode in which electric power supplied to the printing section is low as compared with the normal mode; and in a case that the judgment section judges that the flushing condition is satisfied during the power saving mode and that the image data is stored in the storage section, the controller supplies the electric power, which is larger than that of the power saving mode, to the printing section to print the image.

4. The printing apparatus according to claim 2, wherein the ink includes inks of a plurality of colors; and in a case that the judgment section judges that the flushing condition is satisfied and that the image, the image data of which is stored in the storage section, is to be printed by using an ink, among the inks of the plurality of colors, which has a color to be subjected to execution of the flushing, the controller controls the printing section to print the image.

5. The printing apparatus according to claim 4, wherein in a case that the image, the image data of which is stored in the storage section, is to be printed by using only the ink, among the inks of the plurality of colors, which has the color to be subjected to the execution of the flushing, the controller controls the printing section to print the image.

6. The printing apparatus according to claim 4, wherein in a case that the image data of the image which is to be printed by using the ink, among the inks of the plurality of colors, which has the color to be subjected to the execution of the flushing, is not stored in the storage section, the controller controls the printing section not to execute printing but to execute the flushing.

7. The printing apparatus according to claim 2, wherein in a case that the judgment section judges that the flushing condition is satisfied and that a plurality of image data of images to be printed are stored in the storage section, the controller finds an ink amount to be used in the printing for each of the images and controls the printing section to print an image in which the ink amount to be used in the printing is closest to an ink amount to be discharged by the flushing.

8. The printing apparatus according to claim 2, wherein in a case that the controller controls the printing section to print the image instead of the flushing and that an ink amount used in the printing is less than a predetermined amount to be discharged by the flushing, the flushing is executed at a timing of at least one of before and after the printing.

9. The printing apparatus according to claim 8, wherein the controller controls the printing section to discharge the ink, in the flushing, in an amount which is obtained by subtracting the ink amount used in the printing of the image from the predetermined amount.

10. The printing apparatus according to claim 2, wherein in a case that the controller controls the printing section to print the image instead of the flushing and that an ink amount used in the printing exceeds a predetermined amount to be discharged by the flushing, the controller controls the printing section to discontinue the printing at a point in time at which the ink amount used in the printing exceeds the predetermined amount.

11. The printing apparatus according to claim 2, further comprising a selecting section which receives a selection by a user as to whether or not the image is printed instead of the flushing; and wherein in a case that the judgment section judges that the flushing condition is satisfied, that the image data is stored in the storage section, and that the selecting section receives a selection that the image is printed instead of the flushing, the controller controls the printing section to print the image instead of the flushing.

* * * * *